US009688364B1

(12) United States Patent
Fuqua et al.

(10) Patent No.: US 9,688,364 B1
(45) Date of Patent: Jun. 27, 2017

(54) MODULAR FLOATABLE DOCK SECTION, DOCK ASSEMBLY, AND METHOD FOR CONSTRUCTING A DOCK ASSEMBLY

(71) Applicant: Patriot3, Inc., Fredericksburg, VA (US)

(72) Inventors: Charles Louis Fuqua, Woodbridge, VA (US); Steven Scott Kahre, Spotsylvania, VA (US)

(73) Assignee: Patriot3, Inc., Fredericksburg, VA (US)

( * ) Notice: Subject to any disclaimer, the term of this patent is extended or adjusted under 35 U.S.C. 154(b) by 199 days.

(21) Appl. No.: 14/215,868

(22) Filed: Mar. 17, 2014

Related U.S. Application Data

(60) Provisional application No. 61/793,515, filed on Mar. 15, 2013.

(51) Int. Cl.

| | |
|---|---|
| ***B63B 35/44*** | (2006.01) |
| ***B63B 3/08*** | (2006.01) |
| ***B63B 35/34*** | (2006.01) |
| ***B63B 3/06*** | (2006.01) |
| ***E02B 3/06*** | (2006.01) |
| ***B63B 7/08*** | (2006.01) |

(52) U.S. Cl.
CPC ..... *B63B 35/44* (2013.01); *B63B 3/06* (2013.01); *B63B 3/08* (2013.01); *B63B 7/082* (2013.01); *B63B 35/34* (2013.01); *E02B 3/064* (2013.01)

(58) Field of Classification Search
CPC .. B63B 3/06; B63B 3/08; B63B 35/44; B63B 2035/4493; B63B 35/53; B63B 35/58; B63B 7/082; B63B 35/34; E02B 3/062; E02B 3/064; E01D 15/14; E01D 15/145; E01D 15/20; E01D 15/22
USPC ..... 114/263, 266, 267, 345; 441/30, 40–42, 441/129, 130; 405/218–221; 14/2.6, 27
See application file for complete search history.

(56) References Cited

U.S. PATENT DOCUMENTS

| | | | | |
|---|---|---|---|---|
| 3,152,568 A * | 10/1964 | Mayer | E02B 3/064 | 114/266 |
| 5,915,325 A * | 6/1999 | Gerber | B63B 5/24 | 114/263 |
| 7,000,558 B2 * | 2/2006 | Johnson | B63B 3/08 | 114/266 |
| 7,837,526 B1 * | 11/2010 | Doffay | B63B 35/36 | 114/345 |

(Continued)

FOREIGN PATENT DOCUMENTS

| | | | |
|---|---|---|---|
| DE | 2901893 A1 * | 7/1980 | E04H 4/08 |
| EP | 2251255 A2 * | 11/2010 | B63B 7/082 |

OTHER PUBLICATIONS

Bike Track, Inc.; Modular Plastic Flooring and Command Post Staging Systems; entire brochure; published prior to Mar. 17, 2014.

(Continued)

*Primary Examiner* — Ajay Vasudeva
(74) *Attorney, Agent, or Firm* — Schwartz Law Firm, P.C.

(57) ABSTRACT

A modular floatable dock section comprises a fluid bladder having substantially flat top and bottom surfaces, and a perimeter around the top and bottom surfaces. The fluid bladder is designed for being selectively inflated in a deployed condition and deflated (collapsed) for transport and storage. A generally rigid continuous-surface deck is mounted adjacent the top surface of the fluid bladder, and defines a deck perimeter substantially coincident with the perimeter of the fluid bladder.

19 Claims, 7 Drawing Sheets

(56) References Cited

U.S. PATENT DOCUMENTS

| | | | | |
|---|---|---|---|---|
| 7,921,618 | B2 | 4/2011 | Lovald et al. | |
| 8,702,461 | B1 * | 4/2014 | d'Offay | B63B 7/082 114/345 |
| 2004/0028478 | A1 * | 2/2004 | Lekhtman | B63B 3/08 405/219 |

OTHER PUBLICATIONS

Bike Track, Inc.; Product Details and Technical Data; entire brochure; published prior to Mar. 17, 2014.
Bike Track, Inc.; Bike Track Flooring—Basic Installation Instructions; entire brochure; published prior to Mar. 17, 2014.
Bike Track, Inc.; Bike Track Flooring for Drash TMSS Shelter Systems; entire brochure; published prior to Mar. 17, 2014.

* cited by examiner

MODULAR FLOATABLE DOCK SECTION, DOCK ASSEMBLY, AND METHOD FOR CONSTRUCTING A DOCK ASSEMBLY

TECHNICAL FIELD AND BACKGROUND OF THE INVENTION

This invention relates broadly and generally to a modular floatable dock section, dock assembly, and method for constructing a dock assembly.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a modular floatable dock section. The dock section comprises a fluid bladder having substantially flat top and bottom surfaces, and a perimeter around the top and bottom surfaces. The fluid bladder is designed for being selectively inflated in a deployed condition and deflated (collapsed) for transport and storage. A generally rigid continuous-surface deck is mounted adjacent the top surface of the fluid bladder, and defines a deck perimeter substantially coincident with the perimeter of the fluid bladder. Means are provided for securing the deck to the fluid bladder.

The exemplary dock section may comprise a single integrally-formed fluid bladder and multiple rigid deck panels, or a single integrally-formed deck panel and multiple individual bladder parts.

The term "substantially coincident" is defined herein to mean that the deck (e.g., assembled deck panels) overlies the bladder in such a manner that the respective outer perimeters of the deck and bladder substantially align, or align within a marginal surface area comprising less than 10% of the overall underside surface area of the deck.

According to another exemplary embodiment, the deck is constructed of a molded polymer.

According to another exemplary embodiment, the polymer comprises a high density polyethylene.

According to another exemplary embodiment, the deck has a substantially uniform height dimension of between about 1.0 and 2.0 inches.

According to another exemplary embodiment, the deck comprises at least two like planar deck panels.

According to another exemplary embodiment, the deck panels are interconnected by locking edge pins.

According to another exemplary embodiment, the deck comprises a textured perforated drain-through surface.

According to another exemplary embodiment, the fluid bladder comprises an internal drop-stitch construction. In an alternative embodiment, the fluid bladder may comprises internal spaced apart baffles extending between the top and bottom surfaces.

According to another exemplary embodiment, the dock section has a height dimension of between about 8-10 inches when said bladder is inflated to an internal pressure of between about 6-12 psi. The total height of the dock section reduces to about 2-4 inches when the bladder is in a fully deflated (collapsed) condition.

According to another exemplary embodiment, the fluid bladder comprises a water-resistant polymer, such as Hypalon®.

According to another exemplary embodiment, the fluid bladder comprises a removably capped inflation/deflation port.

In another exemplary embodiment, the present disclosure comprises a dock assembly constructed of a plurality of interconnected modular floatable dock sections, as described herein. The exemplary dock assembly comprises means for joining together adjacent modular floatable dock sections at an elongated (integral) flex joint formed between the dock sections.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
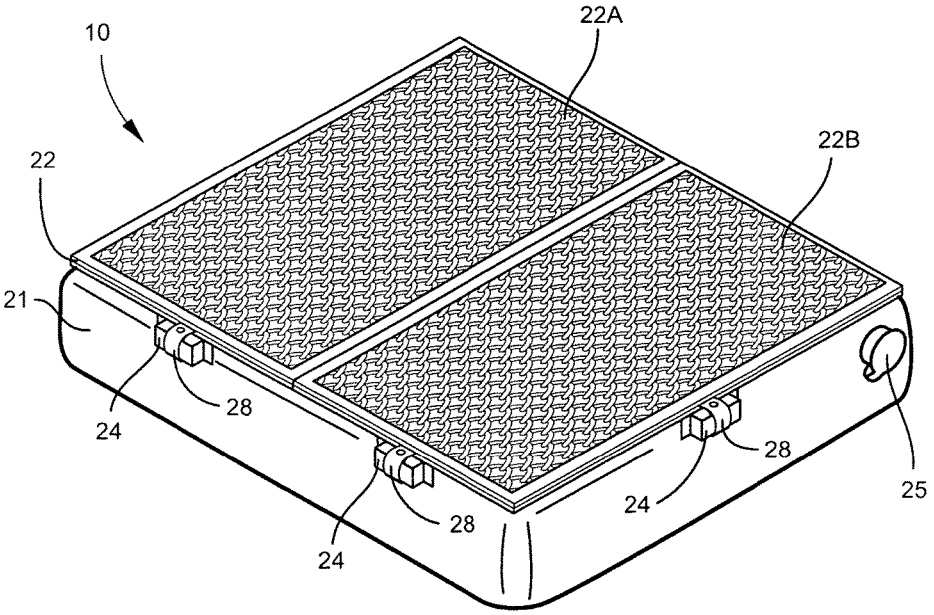
FIG. 1 is a perspective view of the present module dock section according to one exemplary embodiment of the disclosure.
Figure 2:
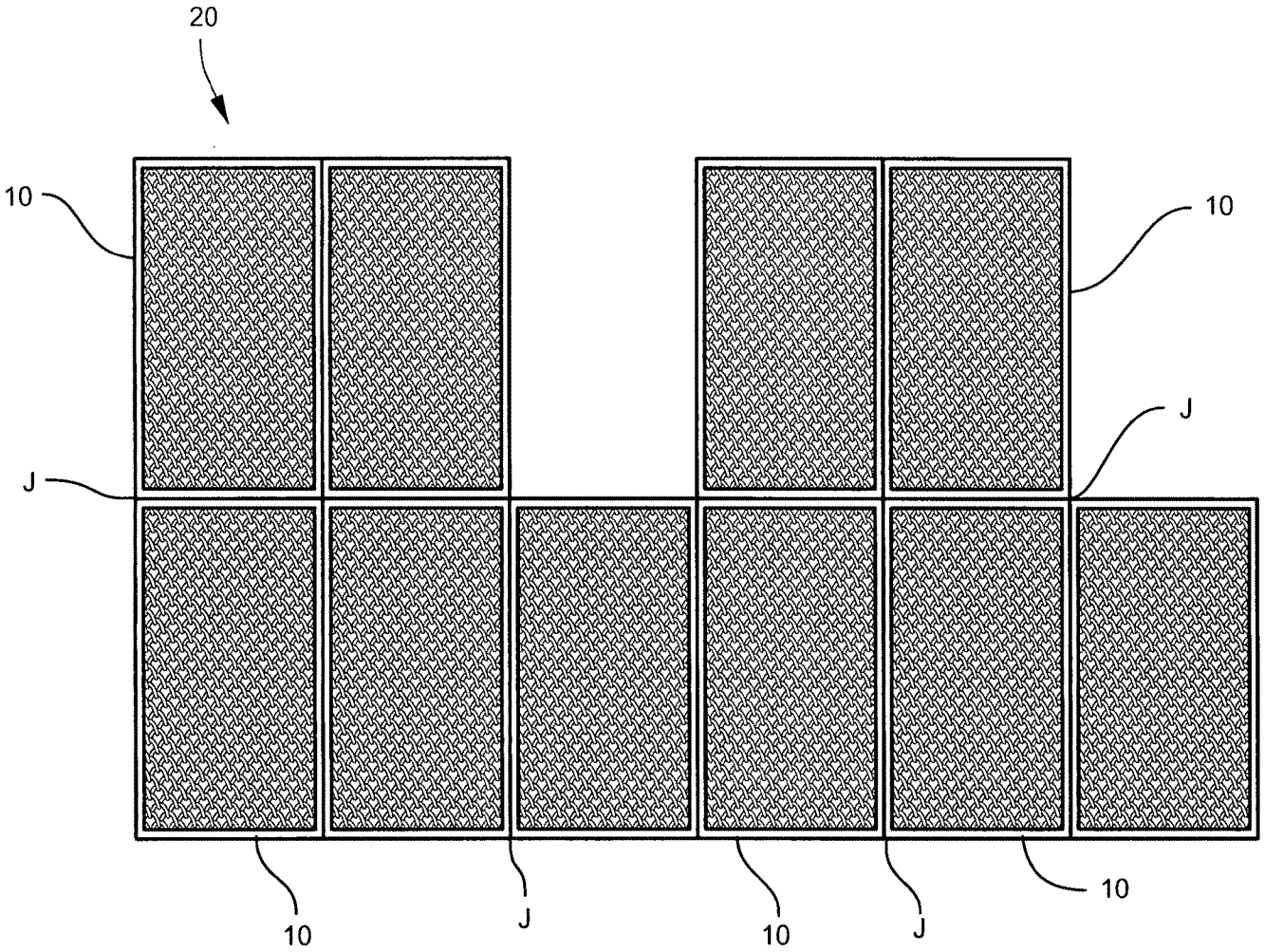
FIG. 2 is an environmental plan view of a floating dock assembly constructed of multiple modular dock sections.

Referring now specifically to the drawings, a modular floatable dock section according to one exemplary embodiment of the present disclosure is illustrated in FIG. 1, and shown generally at broad reference numeral 10. The modular dock section 10 is designed for being assembled together with a number of like dock sections, as shown in FIG. 2, to form a floating dock assembly 20. The geometric configuration of the dock assembly 20 is readily customized, and may vary depending on its particular application. Each modular dock section 10 comprises an air bladder 21 and a generally rigid continuous-surface deck 22 separately secured to the bladder 21. The air bladder 21 has substantially flat top and bottom surfaces 21A, 21B, a perimeter around the top and bottom surfaces 21A, 21B, spaced-apart perimeter nylon anchor loops 24, and a removably capped inflation/deflation port 25. Using the inflation/deflation port 25 and a standard portable positive/negative air source (not shown), the bladder 21 can be quickly inflated into a deployed condition, and deflated (or collapsed) for transport and storage. The rigid deck 22 is mounted adjacent the top surface 21A of the bladder 21, and defines a deck perimeter substantially coincident with the perimeter of the bladder 21.

Figure 3:
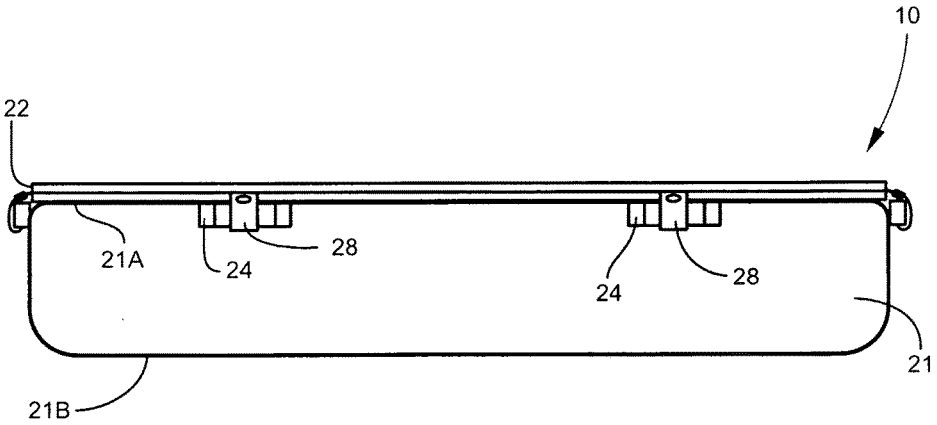
FIG. 3 is a side view of the exemplary dock section.
Figure 4:
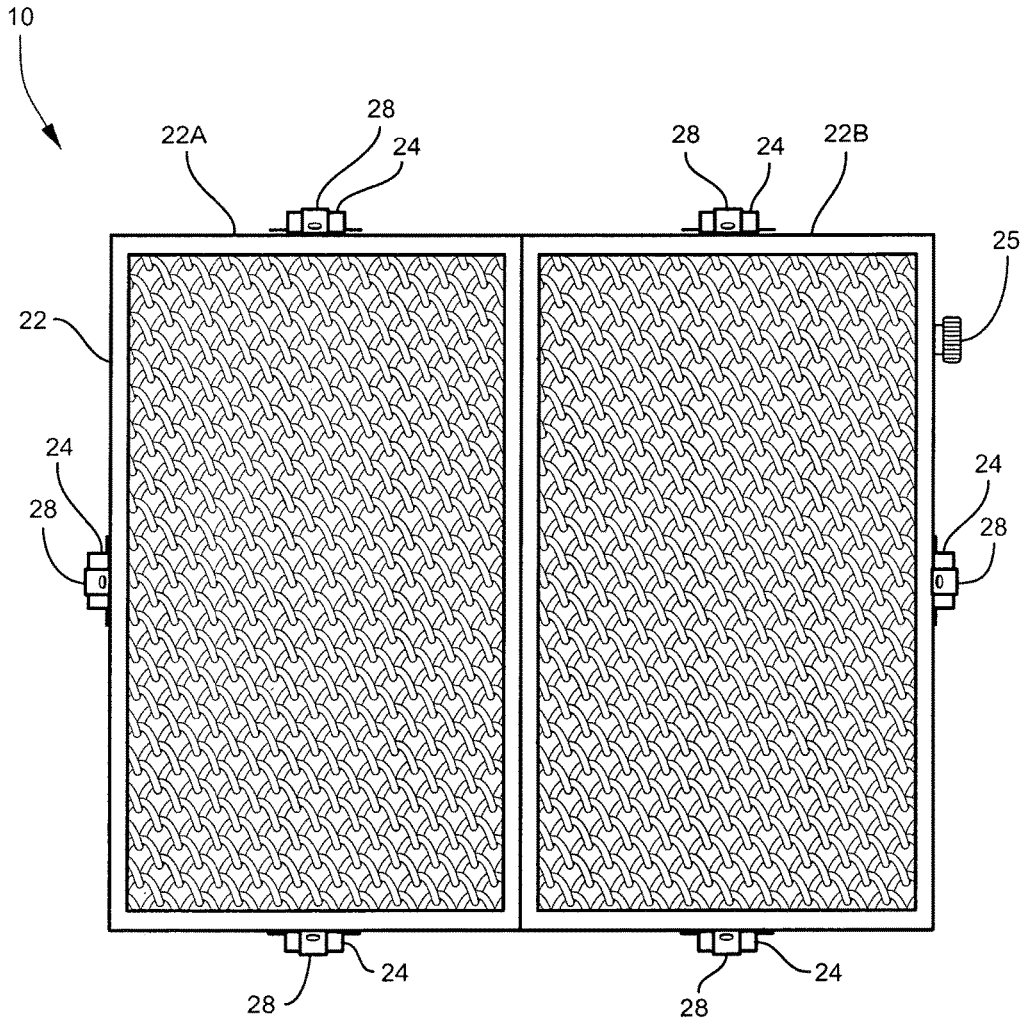
FIG. 4 is a top view of the exemplary dock section.

In one exemplary embodiment, the rigid deck 22 is constructed of a molded polymer, such as a high density polyethylene, and has a textured drain-through surface which rapidly drains or sheds water away from the top of the dock section 10 (thus eliminating potentially hazardous surface puddling). The exemplary polymer may include an anti-static additive, UV inhibitor, antimicrobial, selected color pigments, and other elements and features. In alternative embodiments, the rigid deck 22 may be constructed of a lightweight metal, such as aluminum or the like. As best shown in FIGS. 1, 3, and 4, the rigid deck 22 of each dock section 10 is assembled in two adjacent identical rectangular deck panels 22A, 22B which are mechanically interconnected by locking edge pins, complementary hook and loop fasteners, adhesive, or other suitable attachment means. When assembled and interconnected, the adjacent panels 22A, 22B form a rigid continuous-surface deck 22 having an exemplary dimension of 42" wide by 48" long. The height of the deck 22 is substantially uniform—defined by either 1" or 2" panels 22A, 22B. One example of deck panels 22A, 22B applicable in the present modular dock section 10 is described in prior U.S. Pat. Nos. 5,499,888, 7,490,443, and 7,921,618 owned by Bike Track, Inc. of Woodstock, Vt. The complete disclosure of these prior patents is incorporated herein by referenced.

Figure 5:
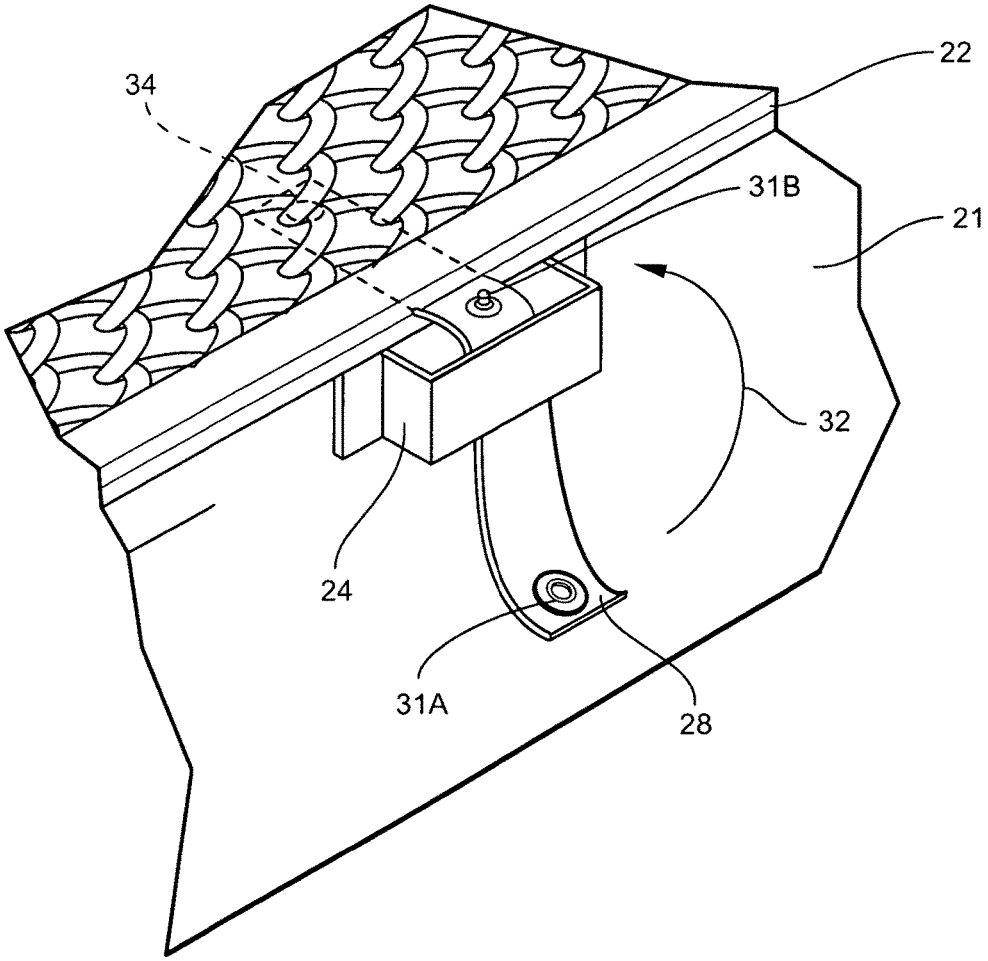
FIG. 5 is a fragmentary perspective of the exemplary dock section, and illustrating one exemplary means for releasably securing the deck to the air bladder.

Referring to FIGS. 1, 3, 4, and 5, the rigid deck 22 of the modular dock section 10 may be releasably secured to the underlying bladder 21 by perimeter nylon straps 28 designed to insert through respective perimeter anchor loops 24 of the bladder 21, and having complementary snaps 31A, 31B (FIG. 5) which align and mate as demonstrated by arrow 32 in FIG. 5. Alternative fasteners may include hook and loop, snaps, buckles, buttons, or the like. As best shown in FIG. 5, the straps 28 may be attached to an underside of the deck 22 at point 34 by rivets, screws, or other such hardware.

Figure 6:
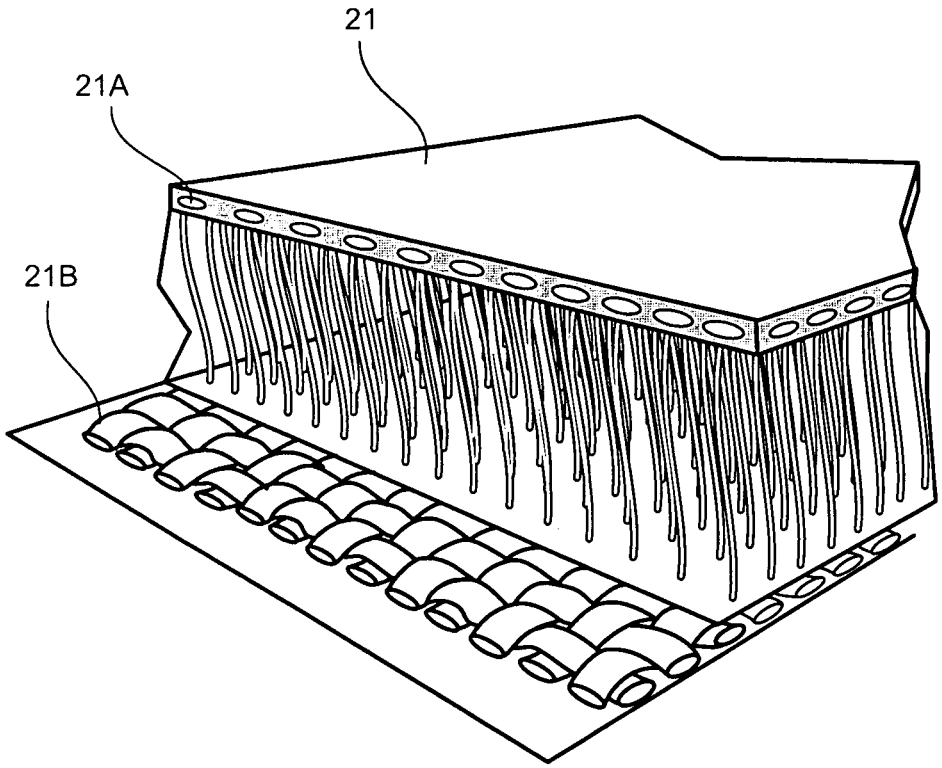
FIG. 6 is a cross-section view of the exemplary air bladder illustrating its internal drop-stitch construction.
Figure 7:
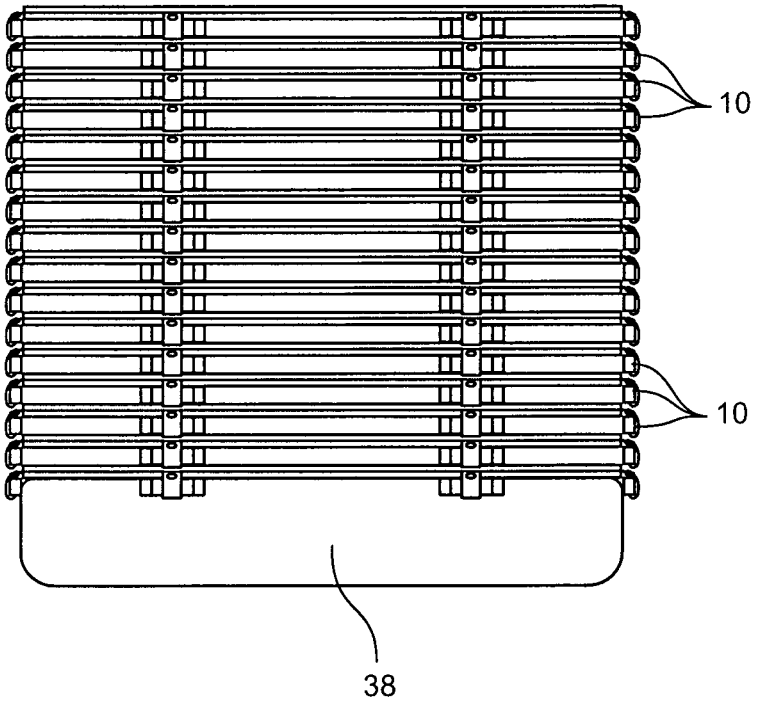
FIG. 7 is a view showing multiple deflated (collapsed) dock sections stacked and loaded on a NATO pallet for transport or storage.

According to one exemplary embodiment, the present air bladder 21 is constructed of a water-resistant polymer, such as chlorosulfonated polyethylene (CSPE) synthetic rubber (CSM). One suitable bladder material is that manufactured by Dupont Performance Elastomers LLC, and known commercially as Hypalon®. Hypalon® is noted for its resistance to chemicals, temperature extremes, and ultraviolet light. As shown in FIG. 6, the exemplary air bladder 21 comprises an internal drop-stitch construction. When inflated to an internal pressure of between about 6-12 psi, the bladder 21 and deck 22 have a combined height dimension of between about 8-10 inches. The total height of the dock section 10 reduces to about 2-4 inches when the bladder 21 is in a fully deflated (collapsed) condition. In the collapsed condition, shown in FIG. 7, the modular dock sections 10 are readily transported and stored on a reusable plastic NATO pallet 38 with a footprint of 1200 mm×1000 mm. For modular dock sections 10 with 1-inch decks 22, a single pallet 38 may ship 14 stacked dock sections 10 at a total height of about 48 inches.

Figure 8:
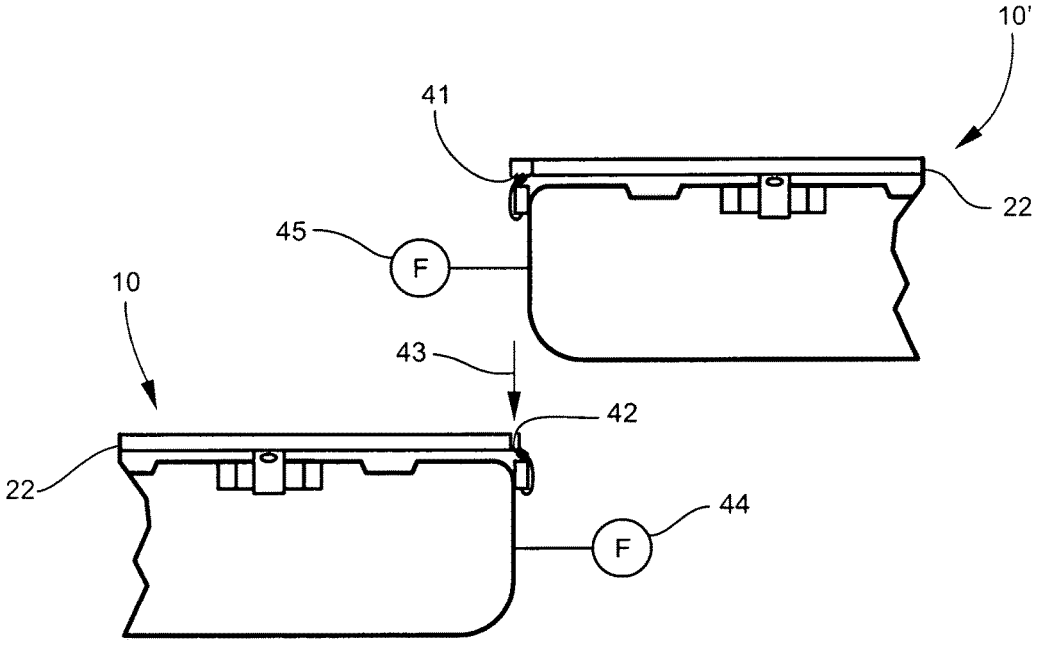
FIG. 8 is a fragmentary side view schematically demonstrating attachment of adjacent modular dock sections in an exemplary dock assembly.

Referring to FIGS. 2 and 8, the exemplary dock assembly 20 is constructed of multiple modular dock sections 10 arranged edge to edge in any desired layout or configuration. The deck 22 of each dock section 10 may comprise integrally formed (e.g., molded-in) tongue and groove edge connector channels 41, 42 designed to overlap when assembled, as indicated at arrow 43 in FIG. 8, and to snap-attach adjacent dock sections 10, 10' together. Additionally, for increased stability adjacent dock sections 10, 10' may comprise other releaseable perimeter fasteners 44, 45, such as complementary hook and loop straps, D-rings, cables, or the like. The adjacent dock sections 10, 10' are self-aligning, and have a substantially articulated design with integral elongated flex joints "J" between sections. The flex joints "J" enable slight movement (rise and fall) and flexing of the dock assembly 20 between adjacent modular sections 10. The dock assembly 20 may be utilized for carrying vehicles, as a foot bridge, to support scaffolding and other construction equipment, or for any other desired industrial, commercial, or recreational application.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A modular floatable dock section, comprising:

a fluid bladder having substantially flat top and bottom surfaces, substantially vertical side walls defining a perimeter around the top and bottom surfaces, and a plurality of spaced-apart anchor loops formed on said side walls, wherein said fluid bladder is configured to be selectively inflated in a deployed condition and deflated for transport and storage;

a generally rigid continuous-surface deck mounted adjacent the top surface of said fluid bladder, and defining a deck perimeter substantially coincident with the perimeter of said fluid bladder, and said continuous-surface deck comprising one of a downwardly-oriented tongue edge connector and an upwardly-oriented groove edge connector integrally formed along said deck perimeter and capable of overlapping with a second complementary edge connector of an adjacent dock section to attach the adjacent dock sections together; and means for releasably securing said deck to said fluid bladder, said means comprising a plurality of flexible straps attached to said deck and releasably secured to said anchor loops of said fluid bladder below the edge connectors of said deck.

2. A modular floatable dock section according to claim 1, wherein said deck is constructed of a molded polymer.

3. A modular floatable dock section according to claim 2, wherein said polymer comprises a high density polyethylene.

4. A modular floatable dock section according to claim 1, wherein said deck has a substantially uniform height dimension of between about 1.0 and 2.0 inches.

5. A modular floatable dock section according to claim 1, wherein said deck comprises at least two like deck panels.

6. A modular floatable dock section according to claim 5, wherein said deck panels are interconnected by locking edge pins.

7. A modular floatable dock section according to claim 1, wherein said deck comprises a textured perforated drain-through surface.

8. A modular floatable dock section according to claim 1, wherein said fluid bladder comprises an internal drop-stitch construction.

9. A modular floatable dock section according to claim 1, wherein said dock section has a height dimension of between about 8-10 inches when said bladder is inflated to an internal pressure of between about 6-12 psi.

10. A modular floatable dock section according to claim 1, wherein said fluid bladder comprises a water-resistant polymer.

11. A modular floatable dock section according to claim 1, wherein said fluid bladder comprises a removably capped inflation/deflation port.

12. A dock assembly comprising a plurality of interconnected modular floatable dock sections, each dock section comprising:

a fluid bladder having substantially flat top and bottom surfaces, substantially vertical side walls defining a perimeter around the top and bottom surfaces, and a plurality of spaced-apart anchor loops formed on said side walls, wherein said fluid bladder is configured to be selectively inflated in a deployed condition and deflated for transport and storage;

a generally rigid continuous-surface deck mounted adjacent the top surface of said fluid bladder, and defining a deck perimeter substantially coincident with the perimeter of said fluid bladder, and said continuous-surface deck comprising one of a downwardly-oriented tongue edge connector and an upwardly-oriented groove edge connector integrally formed along said deck perimeter and capable of overlapping with a second complementary edge connector of an adjacent dock section to attach the adjacent dock sections together; and means for releasably securing said deck to said fluid bladder, said means comprising plurality of flexible straps attached to said deck and releasably secured to said anchor loops of said fluid bladder below the edge connectors of said deck.

13. A dock assembly according to claim 12, wherein said deck comprises a high density polyethylene.

14. A dock assembly according to claim 12, wherein said deck has a substantially uniform height dimension of between about 1.0 and 2.0 inches.

15. A dock assembly according to claim 12, wherein said deck comprises a textured perforated drain-through surface.

16. A dock assembly according to claim 12, wherein said fluid bladder comprises an internal drop-stitch construction.

17. A dock assembly according to claim 12, wherein said dock section has a height dimension of between about 8-10 inches when said bladder is inflated to an internal pressure of between about 6-12 psi.

18. A dock assembly according to claim 12, wherein said fluid bladder comprises a water-resistant polymer.

19. A dock assembly according to claim 12, wherein said fluid bladder comprises a removably capped inflation/deflation port.

* * * * *